US006035915A

United States Patent [19]

Garinger

[11] Patent Number: 6,035,915

[45] Date of Patent: Mar. 14, 2000

[54] TAB DISPENSING APPARATUS AND RELATED METHOD

[76] Inventor: Alan K. Garinger, 501 S. Cr. 550 E., Selma, Ind. 47383

[21] Appl. No.: 09/096,054

[22] Filed: Jun. 11, 1998

Related U.S. Application Data

[60] Provisional application No. 60/048,928, Jun. 16, 1997.

[51] Int. Cl.[7] ..... B65C 3/04; B43M 5/00; B44C 31/00

[52] U.S. Cl. ..... 156/484; 156/441.5; 156/483; 156/542

[58] Field of Search ..... 156/483, 484, 156/485, 541, 542, 441.5, 443, 475, 212

[56] References Cited

U.S. PATENT DOCUMENTS

| | | | |
|---|---|---|---|
| 3,186,890 | 6/1965 | Dorn et al. | 156/354 |
| 3,245,859 | 4/1966 | Busk | 156/479 |
| 4,160,687 | 7/1979 | Spear . | |
| 4,473,429 | 9/1984 | Crankshaw . | |
| 4,758,303 | 7/1988 | Shastko | 156/542 |
| 5,118,375 | 6/1992 | Malachowski et al. | 156/216 |
| 5,122,108 | 6/1992 | Segalowitz . | |
| 5,279,698 | 1/1994 | Davis | 156/483 |
| 5,314,567 | 5/1994 | Noll . | |
| 5,376,217 | 12/1994 | Jeanssen, Jr. et al. | 156/361 |
| 5,635,017 | 6/1997 | Morrow | 156/443 |
| 5,711,846 | 1/1998 | Alicea | 156/556 |
| 5,891,300 | 4/1999 | Oussani, Jr. et al. | 156/541 |

*Primary Examiner*—Richard Crispino
*Assistant Examiner*—Sue A. Purvis
*Attorney, Agent, or Firm*—King and Schickli

[57] ABSTRACT

An apparatus for dispensing an adhesive tab ready for placement on the an edge of a substantially flat article, such as a folded mailer or the like. Adhesive tabs are disposed on a roll formed of a reverse-wound backing strip housed in the base of the apparatus. A manually operable feeder assembly advances the backing strip past an L-shaped stripper secured in the base. In addition to guiding the strip, the stripper assists the foremost tab in partially separating from the backing. The combined action of the advancing strip and the stripper serve to remove the tab from the backing and place the tab over a receiving slot. The article is then inserted into the receiving slot, thereby pressing and sealing the tab onto the edge. Adjustment means allow the advancing motion provided by the feeder to be altered based on the size of tab or spacing between the tabs on the strip. The receiving slot is also fitted with an adjustable applicator for assisting in pressing the tab onto the article edges. A method of manually dispensing tabs for application to the edges of substantially flat articles is also disclosed.

9 Claims, 3 Drawing Sheets

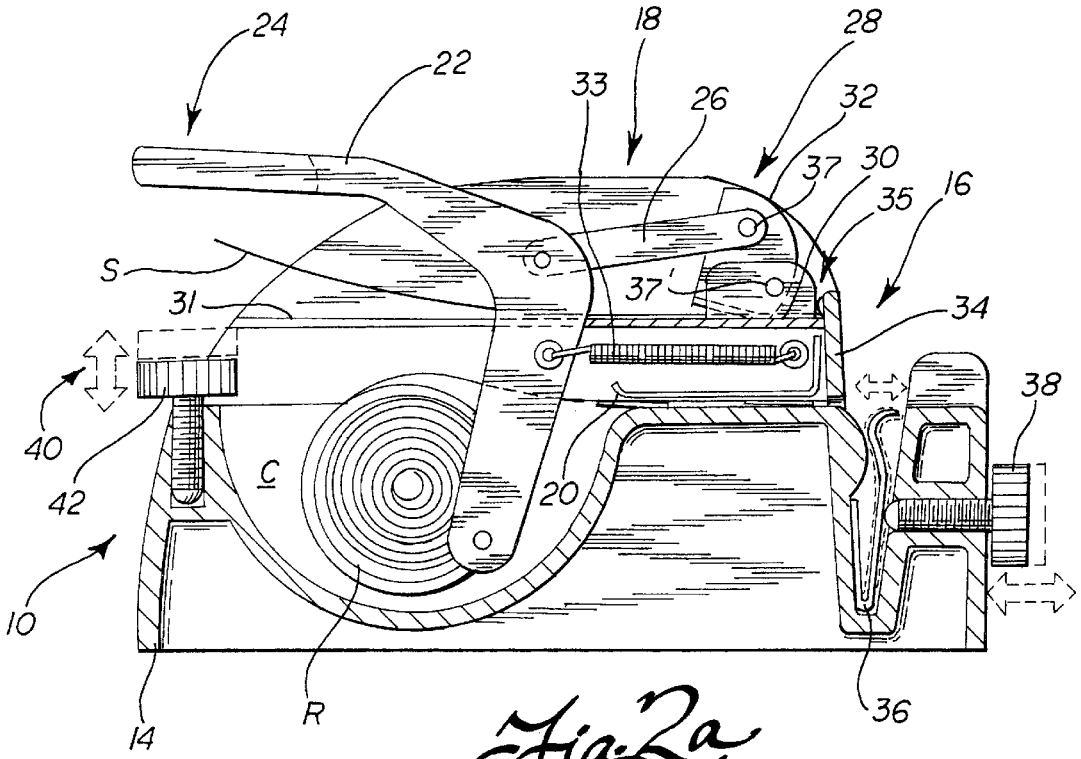
Fig. 2a
Fig. 2b
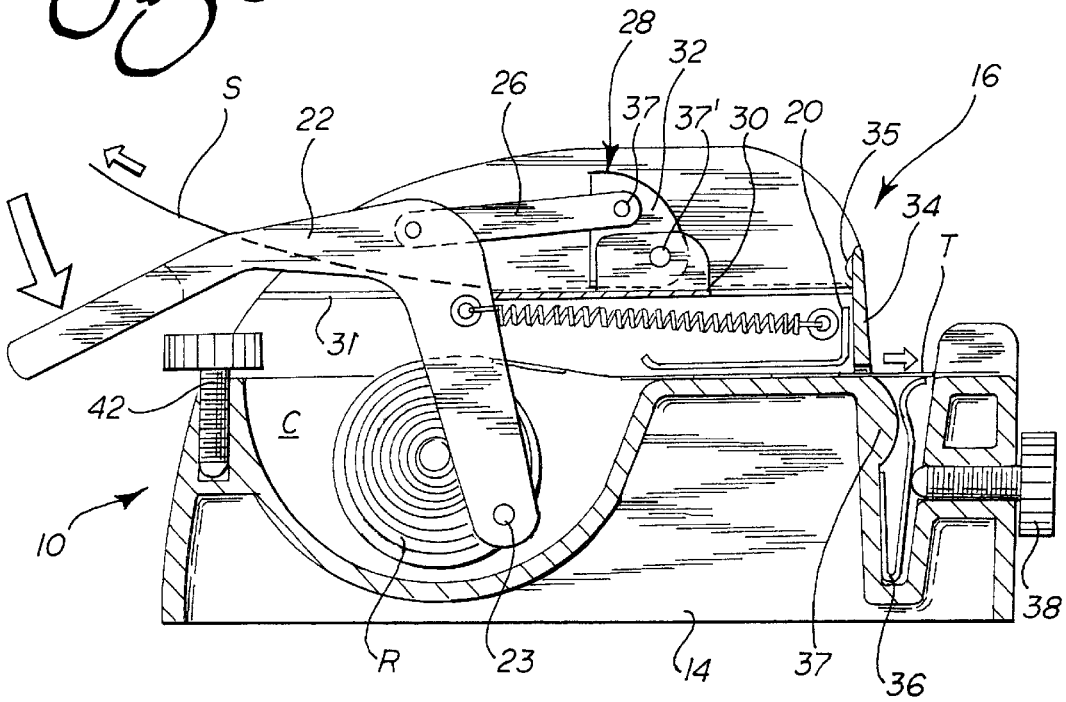

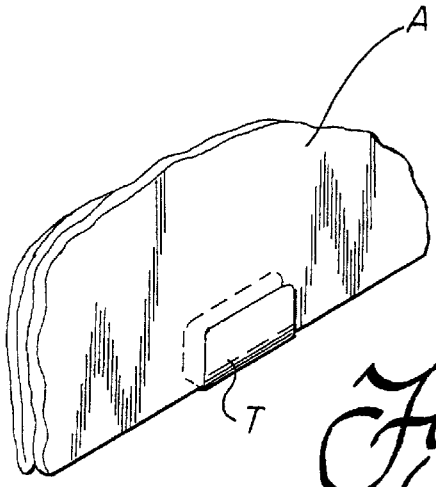
Fig. 3b
Fig. 3a
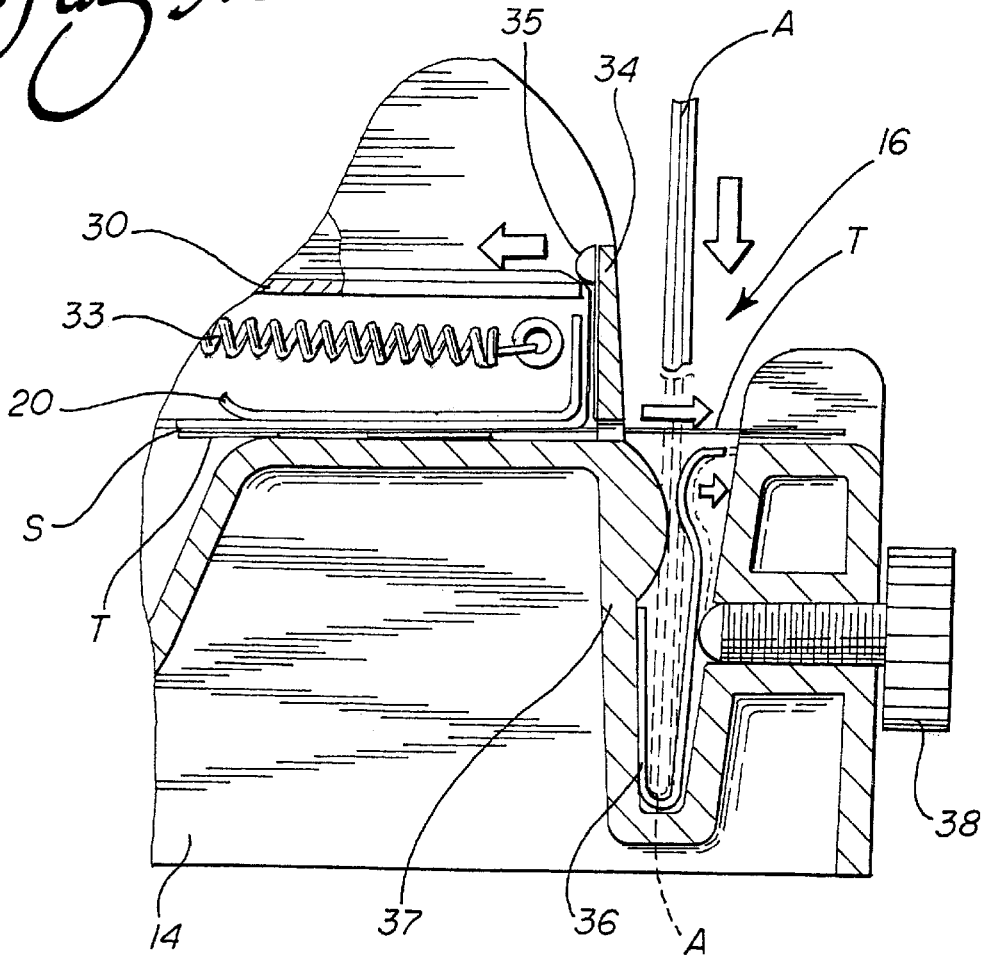

TAB DISPENSING APPARATUS AND RELATED METHOD

This application claims the benefit of U.S. Provisional Application Ser. No. 60/048,928 filed Jun. 16, 1997, entitled "Apparatus for Feeding Closure Tabs."

TECHNICAL FIELD

The present invention relates to the tab dispensing art and, more particularly, to an improved apparatus for dispensing and assisting in placing a tab on the edge of a flat article, such as a folded mailer or the like.

BACKGROUND OF THE INVENTION

Folded mailers have become increasingly popular as a relatively inexpensive way of sending a message or advertisement. Such mailers are formed from one or more sheets of paper folded along the width two or more times, thereby partitioning the paper into two or three sections, respectively. After making the desired number of folds for a particular mailer, it is important that the edges of the folded sections are properly sealed or otherwise closed to prevent undesirable or unwanted opening during mailing.

To this end, it is of course well-known in the art to place staples to secure folded edges of paper articles together. However, placing one or more staples along the edge of a folded mailer makes opening difficult and often results in significant damage to the mailer itself. Moreover, the use of staples is troublesome in view of the advent of automatic mail handling machines. Indeed, the United States Postal Service presently frowns on the use of staples and may ultimately ban their use on such mailers.

Thus, to avoid the problem created by the use of staples, it is known to place a tab along the edge of the folded mailer. Such a tab provides the desirable features of preventing unwanted inspection during mailing, passing through mailing machinery without incident, and permitting opening of the mailer without significant damage, such as with a letter opener or paper knife. The tabs are often adhesive-backed and supplied on sheets or, more commonly, on a thin, elongate backing strip formed into a roll. Thus, placement of the tab about the edge of the mailer requires removing each individual tab from the strip or other backing. Moreover, the tab must then be carefully placed along the edge of the folded article and pressed against the sides to complete the sealing operation. For mailing even a small number of fliers, it should be appreciated that manual performance of this operation is extremely monotonous, time consuming, and an inefficient use of resources.

Previously, others have proposed a variety of automated machines for sealing such folded articles for mailing. However, all of such machines of which I am aware suffer from the problem of being bulky and complex in design. For example, U.S. Pat. No. 5,314,567 to Noll, issued May 24, 1994, discloses a device for adapting an existing postage meter to place adhesive tabs along the edges of folded articles for mailing. While this device results in some cost savings by adapting to existing equipment, it should be appreciated that most home businesses and many small businesses do not have such postage meters available for use. Moreover, the device remains relatively complex in design and also occupies a substantial amount of space, thereby prohibiting desktop storage. Other similar large and complex apparatuses are disclosed in U.S. Pat. No. 5,122,108 to Segalowitz et al. and U.S. Pat. No. 4,160,687 to Spear.

Thus, in view of the foregoing, a need is identified for a simple and inexpensive apparatus for dispensing a tab for placement on the edge of a folded paper article, such as a folded mailer or the like. The apparatus would be manually operable and have a compact design, thereby permitting desktop use and storage. Furthermore, the apparatus would be adjustable to reliably operate for dispensing a variety of sizes of tabs on articles having a variety of thicknesses.

SUMMARY OF THE INVENTION

Keeping the above needs in mind, it is a primary object of the present invention to provide an improved apparatus for dispensing a tab and assisting in placing the tab for sealing the edge of a substantially flat article, such as a folded mailer or the like.

Another object is to provide a tab dispensing apparatus for assisting in placing a tab on the edge of an article that is easy to manually operate.

Still another object is to provide a tab dispensing apparatus that is compact in design, having a small footprint that permits desktop use and storage.

A further object is to provide a tab dispensing apparatus for assisting in placing a tab on the edge of an article that is adaptable for use with a variety of tab sizes and with articles having a variety of thicknesses.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus for dispensing a tab and assisting in affixing the tab to the edge of a substantially flat article is provided. The apparatus includes a base for receiving and holding a strip of tabs, a stripper for guiding the strip and assisting in removing a tab therefrom, and a feeder assembly for advancing the strip past the stripper and through the base. The combined action of the feeder assembly and the stripper serves to place the dispensed tab over a slot formed in the base, whereby insertion of the article edge into the slot affixes the tab and seals the article. As will be appreciated after reviewing the description which follows, the apparatus is advantageously simple and inexpensive in construction, compact in design for desktop use and storage, and easy to manually operate.

More specifically describing the preferred embodiment of the present invention, the apparatus includes a base holding a strip of tabs. The strip of tabs are reverse wound into a roll, such that the tabs face inwardly, thereby facilitating removal using the apparatus of the present invention, as described below. The base also includes a slot for receiving the article on which the tab is to be placed.

Mounted to and housed within the base is a stripper for assisting in lifting a tab from the strip. Additionally, the stripper serves the advantageous functions of receiving and guiding the strip of tabs through the base, as well as assisting in preventing the strip from back feeding through the apparatus. In the preferred embodiment, the stripper is L-shaped, thus forming a 90° bend for guiding the direction of travel of the strip, as described further below.

The feeder assembly advances the strip of tabs through the base and past the stripper. More specifically, the feeder assembly includes a lever for actuating a cam assembly for gripping and pulling the strip of tabs past the stripper. The lever is pivotally mounted to the base and manually operable to actuate the cam assembly. One end of the lever is provided with a handle adapted for receiving the fingers or palm of the user. The opposite end of the lever is connected to the cam assembly. A spring extending between the base and the lever ensures that the lever returns to the original position after the dispensing operation is completed, as described below.

The cam assembly serves to grip and pull the strip past the stripper in response to activation of the lever. More specifically describing the cam assembly, a cam is secured to a plate that is slidably mounted in the base. Preferably, the cam is mounted to the plate such that the cam may rotate, or rock, between tilted or forward, and upright or rearward, positions. The bottom of the cam is provided with a high friction surface, such as a rubberized pad or the like, for contacting and pressing the strip against the plate. A linking member is provided to connect the lever to the cam.

To prepare the apparatus for operation, the strip is fed from the roll held in the base around the L-shaped stripper, between the rocking cam and the plate of the cam assembly, and through the rear of the apparatus. Depressing the lever causes the cam to rock forward into the operative position into contact with the strip. In this position, the cam presses the strip of tabs against the plate. The frictional bottom surface of cam ensures that the strip is held in place against the plate. Further depression of the lever serves to pull the plate rearwardly from a forward resting position in the base. As the plate is pulled toward the rear of the base, the strip is likewise pulled through the base and around the L-shaped stripper.

As the strip is pulled along the bend in the stripper, the tab is partially lifted from the backing. Advancing the strip further feeds the tab outwardly under a face plate formed in the base and toward the receiving slot. As depression of the lever continues, the tab is fully removed from the backing and ultimately placed over the receiving slot, ready for application to the edge of an article forced downward into the receiving slot.

Upon releasing the lever from the depressed position the cam rotates forward, thus disengaging the frictional surface from the strip of tabs and the plate. Release of the lever also allows the plate to return to the forward position by action of a biasing spring. The strip is retained in the newly "advanced" position as a result of frictional resistance supplied by the face plate.

In accordance with an important aspect of the present invention, an adjustable stop is provided in the base for establishing an optimum stroke distance for the lever. Varying the stroke of the lever advantageously allows the apparatus to be used with tabs having different lengths or spacings on the backing strip. More specifically, an increase or reduction in the stroke distance of the lever causes the cam assembly to pull the strip a greater or lesser distance, respectively. Thus, by raising or lowering the adjustable stop, the advancement of the strip is altered to ensure that the tab is fully lifted from the strip and placed in the desired position over the receiving slot.

In accordance with another aspect of the invention, the receiving slot is also provided with an adjustable applicator. In the preferred embodiment, the applicator takes the form of a leaf spring disposed within the slot. A horizontally mounted thumb screw is provided to apply pressure to the spring. For relatively thin-edged articles, such as two or three-fold mailers, the spring can be adjusted to decrease the width of the slot to ensure that the tab is properly pressed onto the edge of the article. For thicker articles, such as pamphlets or small magazines, the pressure on the leaf spring is lowered to permit insertion of the relatively thicker edge of such materials into the receiving slot.

Still other objects of the present invention will become apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and, together with the description, serves to explain the principles of the invention. In the drawing:

FIG. 1 is a perspective view of a preferred embodiment of the improved apparatus for dispensing a tab and assisting in placing the tab along the edge of a substantially flat article, such as a folded mailer or the like;

FIG. 2*a* is a cross-sectional side view of the apparatus of the present invention showing the lever in the initial resting position;

FIG. 2*b* is a cross-sectional side view of the apparatus showing the depression of the lever to activate the cam assembly and pull the strip of tabs from the roll, past the stripper, between the rocking cam and the plate, and out through the rear of the apparatus;

FIG. 3*a* is an enlarged, cutaway cross-sectional view illustrating the manner in which the present invention assists in the placement of a tab along the edge of an article; and FIG. 3*b* is a cutaway perspective view showing the tab placed on the article for closure, such as a folded mailer.

Figure 1:
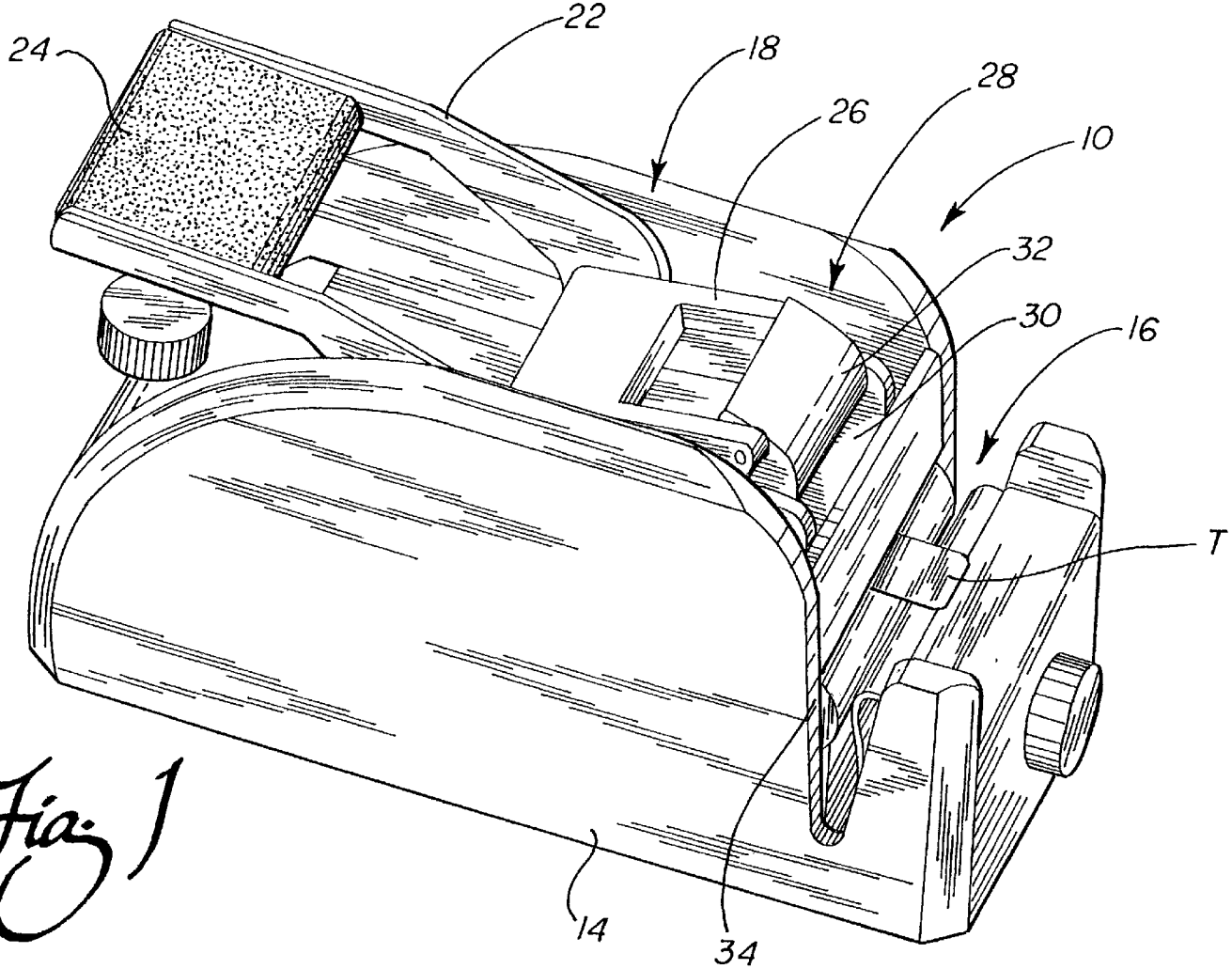

Reference will now be made in detail to the present preferred embodiment of the invention, an example of which is illustrated in the accompanying drawing.

DETAILED DESCRIPTION OF THE INVENTION

Reference is now made to FIGS. 1, 2*a*, and 2*b*, illustrating the improved tab dispensing apparatus 10 of the present invention. As will be further appreciated after reviewing the following description, the apparatus 10 provides a reliable and easy way of dispensing and assisting in the placement of a tab T onto the edge of an article A, such as a folded mailer, pamphlet, catalog or magazine (see FIG. 3*b*).

In the preferred embodiment, the apparatus 10 includes a base 14 which both holds a roll R in the form of a strip S of tabs T and serves as a housing for the components of the apparatus 10. The base 14 also includes a slot 16 for receiving the edge of an article A upon which a tab T is to be placed. As can be appreciated from viewing FIG. 1, the base 14 is compact in design, thereby permitting desktop storage, and is ideally formed of lightweight plastic materials using processes well-known in the art, such as injection molding or the like.

Mounted to the base 14 are components which serve to advance the strip S of tabs T and ensure that a single tab T is placed in position over the receiving slot 16. More specifically, a feeder assembly 18 pulls and a stripper 20 guides the strip S through the apparatus 10. The feeder assembly 18 includes a split lever 22 that is pivotally mounted to the base 12 by means of pins 23, one on each side of the base 14. One end of the lever 22 is provided with a handle 24 that is adapted for receiving the fingers of the operator to facilitate easy, manual depression. The opposite end of the lever 22 is connected to a linkage 26, which is in turn connected to a cam assembly 28. Included in the cam assembly 28 is a plate 30 slidably mounted in the base 14 and a cam 32. In the preferred embodiment, the plate 30 is mounted in horizontal channels or guide tracks 31 formed in the side walls of the base 14. The cam 32 is secured both to linkage 26 and to plate 30 by separate free-pivoting shafts 37, 37', such that limited rotation, or rocking of the cam, is permitted. However, it should be appreciated that variations of the lever 22 and cam assembly 28 shown could also work to provide the feeding operation of the present apparatus. To return the lever 22 to the initial position after operation, reciprocation means are provided, such as biasing spring 33. In the preferred embodiment, the spring 33 is shown as extending between the base 14 and the lever 22.

The stripper 20 is ideally L-shaped, having a 90° bend formed therein. In addition to forming a lower, horizontal channel with the base 14 for guiding strip S through base 14, stripper 20 also assists in redirecting the strip 180° for insertion between the cam 32 and the upper surface of the sliding plate 30. A removable face plate 34 secured in the base 14 adjacent to the upstanding portion of stripper 20 cooperates therewith to form an upper, vertical channel through which the strip S is guided. Ideally, the face plate 34 is provided with an upper protrusion 35 or a separate curved guide (not shown) to aid in preventing the strip S from back feeding during operation, as described further below.

With specific reference to FIGS. 2*a* and 2*b*, the operation of the apparatus of the present invention for dispensing a tab T is illustrated. A roll R comprised of a strip S of tabs T is inserted through the rear of the base 14 and held in a cavity C formed therein. The roll R may either be mounted on an axle or simply resting in cavity C. It should be appreciated that unlike a standard roll, wherein the tabs 14 adhere to an outer surface of the strip, the roll R utilized in the preferred embodiment of the present invention is reverse wound, such that the tabs T are disposed on the inner surface of the strip S (FIG. 2*b*).

To insert the strip S through the apparatus 10, the leading edge is fed through the lower channel formed between the horizontal leg of the stripper 20 and the base 14. To permit access to the leading edge on the opposite side of stripper 20, the face plate 34 is slidably mounted in a vertical channel (not shown). Thus, face plate 34 is removed to permit access to the strip S as it passes under stripper 20. Once through the lower channel, the strip S is then fed upward along the front face of stripper 20, between the rocking cam 32 and plate 30, under linkage 26 and lever 22, and ultimately through the rear portion of the base 14.

Initially, the lever 22 and cam assembly 28 are in a resting position (see FIG. 2*a*). More particularly, the cam 32 is rocked forward (that is, toward the front of base 14) at a slight angle such that an gap is formed between the bottom of cam 32 and the upper surface of the plate 30 (FIG. 2*a*). As lever 22 is depressed (see action arrow in FIG. 2*b*), the rearward motion pulls linkage 26, which in turn rotates cam 32 forward. As should be appreciated, the downward motion of the lever 22 also expands spring 33. As this occurs, the cam 32 is rocked rearwardly such that the lower frictional surface engages and presses strip S against plate 30. Further depressing lever 22 pulls cam 32, which causes plate 30 to slide rearwardly (see FIG. 2*b*) and pull strip S past the stripper 20.

As the strip S moves past the 90° bend formed in stripper 20, the tab T, being more rigid than the flexible strip, is partially separated therefrom. As the front edge of tab T separates, the lower edge of face plate 34 is contacted, which ensures that the tab T is guided substantially in a horizontal direction. In the fully depressed position of lever 22, the strip S is pulled a distance such that the tab T is fully removed and placed over the receiving slot 16 (see action arrow in FIG. 2*b*). Of course, strip S is reverse wound, and, thus, the tab T is positioned with the adhesive surface facing upward, ready for application to an article A.

Upon releasing the lever 22, the biasing action of the spring 33 causes cam 32 to rock forward to the initial position, thus disengaging the frictional surface from the strip S of tabs and the plate 30. Release also permits plate 30 to slide forward into the initial position. However, it should be appreciated that strip S is now in an advanced position. To retain the strip S in this position (that is, to prevent the strip S from feeding backward past the stripper 20), frictional resistance is supplied by the face plate 34. More particularly, face plate 34 is provided with a protrusion 35 or a separate gripper (not shown) for applying pressure to strip S to hold it against stripper 20. Of course, the pressure is sufficient to overcome the force pulling strip S backward past the stripper 20, but is not great enough to present an obstacle to the feeder assembly 18 pulling strip S forward.

To affix the now-removed tab T, the edge of article A is simply inserted into the receiving slot 16 (see vertical action arrow in FIG. 3*a*). The applicator means, such as leaf spring 36, is secured in the receiving slot 16 and expands to assist in pressing the tab T onto the sides of the article A (see action arrow). More specifically, as article A is pushed downward, spring 36 serves to press the tab T against the article A. In the preferred embodiment, the inside surface of the base 14 opposite leaf spring 36 is also provided with a protrusion 37 for assisting in pressing the tab T against the side of article A facing away from the spring 36. However, it should be appreciated that the use of a dual sided leaf spring (not shown) or similar static arrangement secured in slot 16 is also possible. The article A may then be lifted from the slot 16 with tab T in the sealed position (see FIG. 3*b*). Of course, the folded edges are now sealed, and article A is ready for mailing.

In accordance with another aspect of the invention, the applicator means, such as leaf spring 36, is preferably adjustable, thereby permitting use of the apparatus 10 on articles A having thicker edge proportions, such as magazines, pamphlets or the like. In the preferred embodiment, the adjustment means takes the form of a thumb screw 38 threaded through base 14, with the tip of the screw resting against spring 36. As best shown by the pair of dual-sided action arrows in FIG. 2*a*, the screw 38 may be rotated in or out of position to increase or decrease the width between base 14 and leaf spring 36.

The base 14 is also provided with adjustment means 40 to facilitate operation with various sizes of tabs T. For instance, as best shown in FIGS. 2*a* and 2*b*, an upstanding thumb screw 42 is threaded into a mating aperture formed in base 14. This screw 42 forms a stop such that contact is made with lever 22 on the downstroke. Thus, the height of the screw 42 relative to the base 14 serves to define and permit adjustment to the stroke distance of the lever 22. As should be S appreciated, because the stroke distance defines the distance that the feeder assembly 18 will pull the strip S through the apparatus 10, adjustment of this screw 42 is made to accommodate tabs T of different sizes and, more particularly, of different lengths or even to accommodate tabs of different spacings along the backing strip.

In summary, numerous benefits are achieved from employing the concepts of the present invention. The apparatus 10 disclosed advantageously dispenses an adhesive tab T from a strip S, ready for placement on the edge of a substantially flat article A, such as a folded mailer or the like. The tabs T, which are disposed on a reverse-wound backing strip S held in the base 14 of the apparatus, are fed by a manually operable feeder assembly 18. The feeder assembly 18 comprises a manually operable lever 22 connected to a cam assembly 28, which serves to advance the strip through the apparatus past an L-shaped stripper 20. Advancing the strip S along the stripper 20 causes the foremost tab T on the strip to partially separate from the backing. The combined action of the advancing strip S and the stripper 20 serve to fully remove tab T, which is guided into place by a face plate to a position over receiving slot 16 (see FIG. 2*b*). An edge of an article A to be sealed is then inserted into the receiving slot 16, which presses the tab T thereon (see FIG. 3*a*). An adjustment means 40 permits the stroke distance of the lever 22 to be altered depending on the size of tab or the force exerted by a particular user. The receiving slot 16 is also fitted with an adjustable applicator, such as a leaf spring 36, for pressing the tab T onto the article A.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An apparatus for dispensing a tab from a strip and assisting in placing said tab on an edge of a substantially flat article, said apparatus comprising:

a base;

a stripper serving the dual functions of guiding said strip of tabs through said base and at least partially lifting at least one of said tabs from said strip for application to an edge of the substantially flat article;

a manually operable feeder, including a cam assembly for frictionally engaging said strip of tabs for advancement past said stripper in response to the manual actuation of a lever;

said base further including a substantially U-shaped slot for receiving the article edge, said feeder and stripper working in conjunction to fully remove said tab from said strip and place said removed tab on said receiving slot, whereby insertion of said article into said receiving slot affixes said tab to said article edge.

2. The apparatus according to claim 1, wherein said cam assembly comprises:

a plate slidably mounted in said base; and a rocking cam connected to both said lever and said plate, said cam having a high friction surface for gripping said strip of tabs;

whereby said high friction surface presses said strip of tabs against said plate for pulling said strip past said stripper and through said base during operation of said lever.

3. The apparatus according to claim 2, wherein a spring is provided between said base and said lever, said spring assisting in returning said lever to a ready position after operation.

4. The apparatus according to claim 3, wherein said base further includes an adjustable stop for establishing a stroke distance for said lever, whereby the operation of said lever advances said strip such that a single sealing tab is positioned over said receiving slot.

5. The apparatus according to claim 4, wherein said base includes a cavity for holding a roll formed from said strip of tabs.

6. The apparatus according to claim 5, wherein said stripper is a substantially L-shaped guide for receiving said strip of tabs from said roll and guiding said strip through said base;

said base further including a face plate mounted adjacent to said L-shaped guide, said face plate assisting in guiding said strip past said stripper, whereby advancing said strip along said L-shaped guide serves to lift said tab from said backing.

7. The apparatus according to claim 1, wherein said receiving slot further includes at least one adjustable applicator for assisting in pressing said tab onto said article upon insertion in said receiving slot.

8. The apparatus according to claim 1, wherein said tabs are adhesively mounted to said strip, said strip being reverse wound into a roll such that said stripper lifts said tab with the adhesive surface facing upward and places said tab over said slot for affixation on the edge of said article.

9. An apparatus for dispensing a single tab from a strip of tabs and assisting in placing the single tab on an edge of a substantially flat article, said apparatus comprising:

means for guiding the strip of tabs;

means for stripping the single tab from the strip;

means for advancing the strip past said stripping means to fully detach the single tab;

means for manually actuating said advancing means; and means for receiving the edge of the substantially flat article;

said advancing means and stripping means working in conjunction to fully remove the tab from the strip and place the removed tab on the article edge receiving means, whereby insertion of said article into said receiving means affixes said tab to said article edge.

* * * * *